United States Patent [19]

Matsuura et al.

[11] 4,403,996

[45] Sep. 13, 1983

[54] METHOD OF PROCESSING LOW RANK COAL

[75] Inventors: Yoshio Matsuura, Funabashi; Michio Kurihara, Mitaka; Takao Kamei, Ashiya; Akira Nakamura; Keiichi Komai, both of Akashi; Takeshi Wakabayashi, Kobe, all of Japan

[73] Assignees: Electric Power Development Co., Tokyo; Kawasaki Jukogyo Kabushiki Kaisha, Kobe, both of Japan

[21] Appl. No.: 347,466

[22] Filed: Feb. 10, 1982

[51] Int. Cl.[3] ..... C10L 9/08; C10L 5/32; C10L 1/32

[52] U.S. Cl. ..... 44/1 G; 44/6; 44/51; 208/8 LE

[58] Field of Search ..... 44/1 G, 6, 51; 208/8 LE

[56] References Cited

U.S. PATENT DOCUMENTS 1,390,232 9/1921 Bates ..... 44/51
3,985,517 10/1976 Johnson ..... 44/1 G
4,081,251 3/1978 Colli ..... 44/1 G
4,159,897 7/1979 Doehlert ..... 44/51

FOREIGN PATENT DOCUMENTS 53-112903 10/1978 Japan ..... 44/1 G

*Primary Examiner*—Carl F. Dees
*Attorney, Agent, or Firm*—Kerkam, Stowell, Kondracki & Clarke

[57] ABSTRACT

Method of processing low rank coals which comprises steps of classifying crushed low rank coals into middle sized lumps and minute particles, subjecting the middle sized lumps to a non-evaporating dehydration treatment to produce low moisture content coals, separating ash content from the minute particles and then at least partly liquefying the minute particles to produce liquefied oil, and mixing the liquefied oil with the low moisture content coals to thereby produce low moisture coal-oil slurry. The method makes it possible to utilize even small sized particles of coal in a practical manner.

5 Claims, 1 Drawing Figure

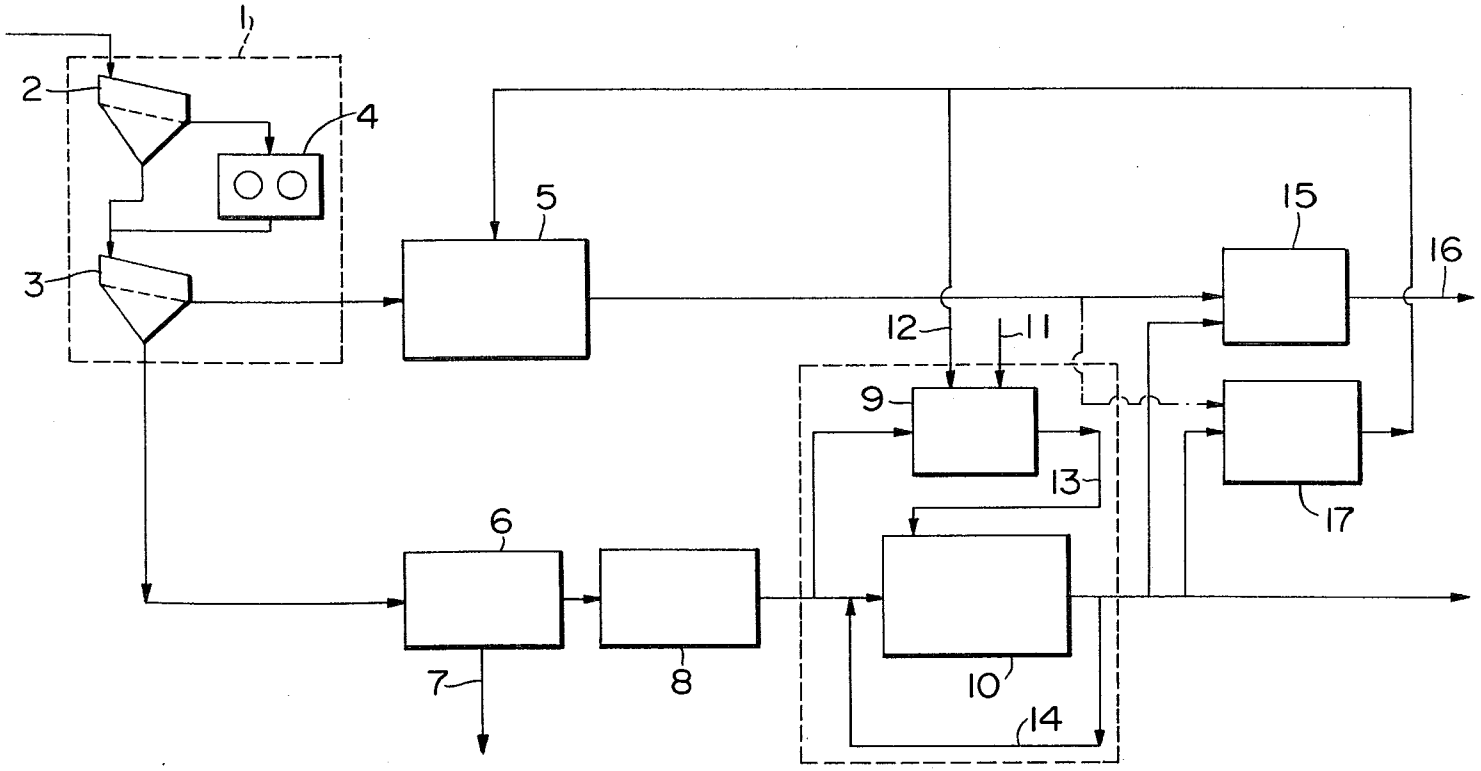
1
2
3
4
5
6
7
8
9
10
11
12
13
14
15
16
17

METHOD OF PROCESSING LOW RANK COAL

This invention relates to the method of processing low rank coals such as brown coal, lignite, and subbituminous coal (hereinafter called as "brown coal"), which highly contain moisture and volatile matters, for producing low moisture content, oil coated coal, or oil slurry of low moisture content coal.

Among low rank coals, brown coal has not been well used except in the vicinity of coal-mines because transportation is impractical since it has a danger of spontaneous combustion due to its high content of volatile matter and since it contains a high percentages of moisture.

Due to unstable oil supply in recent years, development of techniques is being expedited in order to effectively utilize low rank coals, particularly brown coal. In effective utilization of brown coal, the important point to solve transportation and energy efficiency problems is to reduce its weight by dewatering or dehydrating its highly contained moisture. Brown coal can generate 6,000–7,000 k cal/kg at completely dehydrated basis, but its 20–70% moisture causes lowering of calory per unit weight, as well as necessity of huge amount of power for its transportation. To solve these defects dewatering or dehydration of brown coal is considered, however, this is uneconomical as this requires a huge heat energy for evaporating the moisture, and also causes risk of producing minute powder of dehydrated brown coal which leads to production of coal dust and to spontaneous combustion. It is also considered to dehydrate the coal by non-evaporation method, which is to separate moisture, without evaporation, by heating brown coal with steam or highly heated water under high pressure. This method has a problem that treatment of minute powder of brown coal is not easy and the efficiency of utilization of the coal is therefore decreased.

On the other hand, since brown coal highly contains volatile matter, it retains high risk of explosion after being dehydrated even by non-evaporating dehydration method although the method decreases the volatile matter during the process. Therefore, in order to secure stability of the dehydrated coal in storage and transportation, it is necessary to cover the coal by an atmosphere of inert gas such as nitrogen or combustion gas, or to coat it with crude oil so as not to injure its ability as a fuel. However, the use of an inert gas is not economical because an additional power is required for its production. The method of coating brown coal with crude oil have been proved as quite effective, by the study of the inventors of this invention, for the prevention of not only the spontaneous combustion but also creation of coal dust during transportation. Thus, coal coating method is quite convenient, however, in case there is no crude oil in coal mining area, crude oil must be transported from other areas and this causes a further problem from the economical point of view.

It is therefore an object of the present invention to provide a method for processing low rank coals in which the aforementioned problems can be solved.

Another object of the present invention is to provide an economical method for processing low rank coals, which can obtain a low moisture coal-oil slurry which has no risk of spontaneous combustion and is suitable for storage and transportation.

According to the present invention, the above and other objects can be accomplished by a method of processing low rank coals which comprises steps of classifying crushed low rank coals into middle sized lumps and minute particles, subjecting the middle sized lumps to a non-evaporating dehydration treatment to produce low moisture content coals, separating ash content from the minute particles and then at least partly liquefying the minute particles to produce liquefied oil, and mixing the liquefied oil with the low moisture content coals to thereby produce low moisture coal-oil slurry or low moisture oil coated coal.

The above and other objects and features of the present invention will become apparent from the following descriptions of a preferred embodiment taking reference to the accompanying drawing which shows a flow chart of an apparatus for carrying out the method of the present invention.

By way of an example, the following descriptions will be made with reference to the processing of brown coal containing 20 to 60% of moisture and 10 to 20% of ash. Referring to the drawing, the reference numeral 1 designates a crushing and classifying device which consists of a first screen 2, a second screen 3, and a crusher 4. The mined coal is thrown in the first screen 2 by a conveyor or other suitable means, and classified into large lumps of coal, for example, of larger than 150 mm in diameter and middle sized and small sized particles. The large lumps are further crushed in the crusher 4 and then thrown in the second screen 3 together with the smaller particles in order to be classified into middle sized lumps of 6–150 mm in diameter and minute particles of which diameter is less than 6 mm. As is the general case, ash content is substantially concentrated in the minute particles. Then, the middle sized lumps are led to a non-evaporating dehydrator 5 to be processed by a non-evaporating dehydration method by being heated with steam or highly heated water under high pressure, then to be separated to dehydrated brown coal (low moisture coal) and water under normal pressure. Brown coal contains oxygen in the form of functional groups such as —COOH group, —OH group, and —CO group, and due to the existence of these hydrophilic groups, brown coal contains much moisture in its capilary, and because of this, if it is heated in a non-evaporating atmosphere in which moisture cannot evaporate, for example, saturated steam atmosphere, the functional groups of —COOH and other groups are dissolved to produce dissolved gases, mainly carbon dioxide, with the result that moisture is separated in the form of liquid water. Thus in the dehydration under the non-evaporation method, it is not necessary to supply a huge amount of heat (approximately 550 k cal/kg) which is usually required in evaporating water. More specifically, plural autoclaves are combined, and raw coal is thrown in one of these autoclaves to be preliminary heated by being supplied with high temperature waste water from another autoclave which is in another processing stage, and then this preheated raw coal is further supplied with high temperature waste water or steam from a further autoclave which is in a highly heated condition, so that the coal be heated to a high temperature, and finally supplied with a fresh saturated steam of high temperature and high pressure or highly heated water of high pressure from a boiler. With this process, the liquid form dehydration of coal is completed at the final pressure and temperature.

In this way, the heated waste water from one autoclave is led to the next autoclave, and the heat in the steam, or the hot water as well as that in the dehydrated water is utilized for preliminary heating processing. Thus, the temperature of the waste water is as low as 100° C. or less so that a highly economical result can be established. In case of dehydration of raw coal by a conventional fluidized bed dryer, it is required for evaporating 1 kg of moisture a heat equivalent to 1.2 to 1.5 kg of steam, however, the heat required in non-evaporating dehydration method is only 0.5 to 0.8 kg which is nearly half of the heat required in the conventional process. It has been known that non-evaporating dehydration cannot effectively applied to small particles of coal having particle size of smaller than 6 mm. And there is also the fact that such small particles contain relatively large amount of ash.

The small particles of coal having diameter less than 6 mm is transferred from the device 1 to a coal washing apparatus 6 so as to remove the ash content therefrom. The ash content thus separated from the coal content is taken out through an ash discharge conduit 7. A flotation type coal washing apparatus may be used for the washing apparatus 6. In such a type of coal washing apparatus 6, the coal particles are charged in a vessel containing water and additives, and bubbles of air are introduced into the vessel at the bottom portion thereof. The brown grain coals are moved to the water surface since they are apt to be adhered to the bubbles. The ash content is therefore deposited in the bottom of the vessel. The separated coal particles are then transferred to a drying device 8 such as a fluidized bed type drying device to be dried therein. The dried coal particles are then applied in part to a gasifying device 9 and in the remaining part to a liquefying device 10. The gasifying device 9 is supplied with air or oxygen through a supply conduit 11 and with steam through a supply conduit 12 and the hydrogen and carbon monoxide produced in the device 9 are supplied through a conduit 13 to the liquefying device 10.

The liquefied oil as produced in the device 10 is in part circulated through a circulating conduit 14 and mixed with small particles of coal to form a slurry which is pressurized by a suitable pump (not shown) and heated to a predetermined temperature. Thereafter, the slurry is introduced into the liquefying device 10. In liquefying the coal particles anyone of known types of coal liquefying device may be used. In the liquefying device 10, it is not necessary to perform a complete liquefaction because the purpose of the liquefaction is to add oil to the coal lumps or to make a oil slurry from the coal lumps. Thus, even a mixture of brown coal and oil can be used provided that the liquid content is sufficiently high.

The liquefied oil as produced in the device 10 is transferred together with the low moisture coal from the dehydrating device 5 to an agitating device 15 such as a rotary drum type agitator or a slurry forming tank having a mixer. In the device 15, the low moisture coal is added or mixed with the liquefied oil to be coated with the oil and form a low moisture coal-oil slurry. The slurry thus produced is taken out through a conduit 16.

A part of the liquefied oil, a part of the dehydrated middle sized coal particles and/or a part of the small sized coal particles having a particle size less than 6 mm are supplied to a boiler 17 to be burnt therein. The boiler 17 produces steam which is supplied to the dehydrating device 5 and the gasifying device 9. According to the process described above, since only the group having a particle size less than 6 mm is washed and liquefied, the types and the number of the crusher and the screen for coal washing can be minimized (Generally, the coal needs to be pulverized, before being washed), and also the quantity to be liquefied can be minimized (If all of the coal having the particle size of 0 to 150 mm is to be liquefied, the energy requirement will be huge). Even small sized particles can be effectively and economically used.

The invention has thus been shown and described with reference to a specific example, however, it should be noted that the invention is in no way limited to the details of the described processes but changes and modifications may be made without departing from the scope of the appended claims.

We claim:

1. Method of processing low rank coal which comprises steps of classifying crushed low rank coals, on the basis of a particle-size borderline point for separation on the order of millimeters, into coal-rich middle sized lumps and minute particles containing ash content at a rate greater than that of the ash content of the coal-rich middle sized lumps, subjecting the middle size lumps to a non-evaporating dehydration treatment to produce low moisture content coals, separating ash content from the minute particles and then at least partly liquefying the minute particles to produce liquefied oil, and mixing the liquefied oil with the low moisture content coals to thereby produce a mixture of low-moisture coal and oil.

2. Method in accordance with claim 1 in which the low rank coal is brown coal.

3. Method in accordance with claim 1 in which the middle size lumps have particle size of 6 to 150 mm and the minute particles have particle size less than 6 mm.

4. Method in accordance with claim 1 in which the mixture is coal-oil slurry.

5. Method in accordance with claim 1 in which the mixture is oil coated coal.

* * * * *